US006439064B1

(12) United States Patent
Fanguy

(10) Patent No.: US 6,439,064 B1
(45) Date of Patent: Aug. 27, 2002

(54) HAND TONG HAVING TACTILE TORQUE INDICATION

(76) Inventor: Robert P. Fanguy, 3507 Captain Cade Rd., Broussard, LA (US) 70518

( * ) Notice: Subject to any disclaimer, the term of this patent is extended or adjusted under 35 U.S.C. 154(b) by 0 days.

(21) Appl. No.: 09/825,535

(22) Filed: Apr. 2, 2001

(51) Int. Cl.[7] ..... B25B 23/14
(52) U.S. Cl. ..... 73/862.25
(58) Field of Search ..... 73/862.21, 862.23, 73/862.25; 81/3.4, 3.44, 378, 379

(56) References Cited

U.S. PATENT DOCUMENTS

| | | | | | |
|---|---|---|---|---|---|
| 1,334,250 | A | | 3/1920 | Langford | |
| 2,093,788 | A | | 9/1937 | Vaughn | |
| 4,137,758 | A | | 2/1979 | Rodland | |
| 4,289,021 | A | | 9/1981 | Nelson | |
| 4,467,678 | A | * | 8/1984 | Lindholm | 81/483 |
| 4,535,659 | A | * | 8/1985 | Yang | 81/478 |
| 5,123,289 | A | * | 6/1992 | Potesta | 73/862.23 |
| 5,331,868 | A | * | 7/1994 | Elmore | 81/165 |
| 5,509,316 | A | | 4/1996 | Hall | |
| 5,537,877 | A | * | 7/1996 | Hsu | 73/862.23 |
| 5,571,014 | A | * | 11/1996 | Gregory et al. | 433/141 |

* cited by examiner

*Primary Examiner*—Max Noori
(74) *Attorney, Agent, or Firm*—Robert N. Montgomery

(57) ABSTRACT

A tong wrench having gripping jaws for gripping tubular members and a handle adapted thereto for applying an actuating force in a manner so as to effect pivotal movement of the handle and create a tactile and audible indication to an operator when a predetermined but selectively variable torque is applied to the handle to generate the actuating force.

3 Claims, 1 Drawing Sheet

HAND TONG HAVING TACTILE TORQUE INDICATION

BACKGROUND OF THE INVENTION

1. Field of the Invention

This invention relates generally to manually manipulated tong wrenches used for making and breaking joints between adjacent threaded tubular members and more particularly to a hand manipulated tong wrench tool having adjustable, tactile indication of the torque force being applied to the tool.

2. General Background

In the Oil and Gas industry it is common practice to make up or couple threaded tubular members in order to provide extended strings of pipe, tubing, etc. The wrench or tool utilized to provide the torque necessary to assemble threaded tubular elements is known as a pipe tong. The tong is a specific type of wrench or tool that typically includes a set of articulated jaws containing dies for grippingly engaging the exterior diameter of one of the adjacent threaded tubular members. The other member is held stationary with respect to the first member and an actuating force is applied to a tong handle so that the necessary torque may be applied to the first member to make up or break out the threaded interconnection.

Manually operable tongs typically may contain two or more pivotally interconnected jaw members that may be closed into gripping engagement about a threaded member in anticipation of the application of a torque thereto. When the application of the force is completed, the jaws are opened so as to permit removal of the tongs from around the pipe joint. The handle is the moment arm through which the force to effect the make up or break out of the threaded joint between the members may be applied. Such manual tong tools may be relatively small for hand operation on small diameter threaded tubular members or relatively large for use in making up down hole, large diameter threaded tubular members. Examples of such hand tools are disclosed in U.S. Pat. Nos. 1,334,250, 2,093,788 and 4,289,021.

Alternatively, there are arrangements known in the art as power tongs whereby the jaws are disposed in a housing circumferentially encompassing the bore opening and through which protrude the threaded members. This tong's arrangement is typically hydraulically operated and includes a tong lift arrangement whereby the tongs are raised and lowered to a predetermined operating position about a horizontal datum at which the joint to be made up or broken-out is located. One set of jaws, (the "back-up" jaws) is then moved radially inwardly into gripping engagement with one of the members while another set of jaws (the "driven" jaws) are moved into gripping engagement with the member which is to be rotated with respect ,to the first. A hydraulic tongs motor or the like applies the force, which is used to effect the make up or break out of the joint between the adjacent threaded members.

In the case of both the manual and the power driven tongs, it is advantageous to have some indication as to the magnitude of the torque applied to the threaded member. This indication has utility, for example, to prevent the application of excessive torque to the threaded member. Such torque sensing tools are disclosed in U.S. Pat. Nos. 4,137,758, 4,289,021, and 5,509,316

In the power tongs arrangement it is conventional to provide some feedback signal from the hydraulic tongs motor indicative of the amount of hydraulic pressure applied to the driven tongs. In the large diameter, manually operable tongs a suitable tension meter, load cell, or the like is affixed to a cable or chain linking the end of the tong tool moment arm to a stationary element or to a force generating arrangement and thereby obtaining an indication as to the magnitude of the force applied to the handle.

It will be observed, however, that both of the above-described conventional methods are "indirect" in the sense that they provide an indication of the force applied to the end of the moment arm of the jaws distant from the end of that arm in proximity to the gripping jaws. It is believed to be equally advantageous to provide the relatively small hand or manually operated tong tool with adjustable tactile sensing capability disposed in the handle of the hand tong tool, thereby providing an indication of when the preset torque setting for a particular application has been achieved.

It is a conventional practice in many manufacturing processes to employ torque wrenches, which enable the tightening of threaded fasteners such as screws and bolts and the like to a predetermined tightness through the application of a predetermined torque. Torque wrenches are known which include indicators adapted to provide a visual indication to the operator of the torque being applied so that the operator does not apply a greater torque than intended. While such torque wrenches have proven satisfactory where visual observation of the indicator is unobstructed, obvious drawbacks exist where visual observation of the torque indicator is obstructed or otherwise made difficult, as is the case in making-up threaded tubular members. To overcome this problem, torque wrenches have been developed which provide a non-visual indication to the operator when a predetermined torque has been reached, such as an audible "click" or a movement providing "feel" to the operator when the predetermined torque has been reached. See, for example, U.S. Pat. Nos. 2,786,378, 3,165,014, 3,577,815 and 4,467,678. However, heretofore tong type pipe wrenches have not employed such a capability.

SUMMARY OF THE INVENTION

This invention relates to a tong pipe wrench for manually making joints between adjacent threaded members such as threaded tubular members, such as pipe, or solid round members, such as sucker rods or the like. The invention is useful in connection with any tong having jaws adapted to grippingly engage one of the threaded members and further including a handle by which a manual actuating force is applied to the jaws to effect the making up of the joint between the members. In accordance with this invention, a torque wrench is adapted and calibrated to the tong head and serves as the handle portion of the tong tool and is operable to generate an adjustable, preset tactile indication of the force applied to the handle to effect the making-up of the joint. The pipe tong wrench in this case provides a non-visual indication to the operator when a predetermined torque has been reached, such as an audible "click" or a movement providing "feel" to the operator when the predetermined torque has been reached.

Typically this is achieved by providing a spherical coupling member interposed between a free end of a shank fixed to a conventional manual tong wrench head and an operating handle pivotally connected to and coaxial over the shank and carrying a follower which acts against the spherical member so as to maintain the spherical member within mutually opposed generally semispherical recesses in the shank and follower until a predetermined torque is reached, at which time the operating handle pivots relative to the shank with a resultant "click" of the shank against the inner surface of the handle to provide an audible and sensory feel indication to the operator that the predetermined torque has been reached. A means for adjustably presetting the biasing force applied by the follower member against the spherical coupling member provides the wrench with a torque set point.

It is therefore an object of the present invention to provide manually operated tongs with a tactile and audible indication of a preset torque when a rotary force is applied thereto.

Another object of the invention is to provide a manual tong having a means for calibrating a preset torque for pipe make-up.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
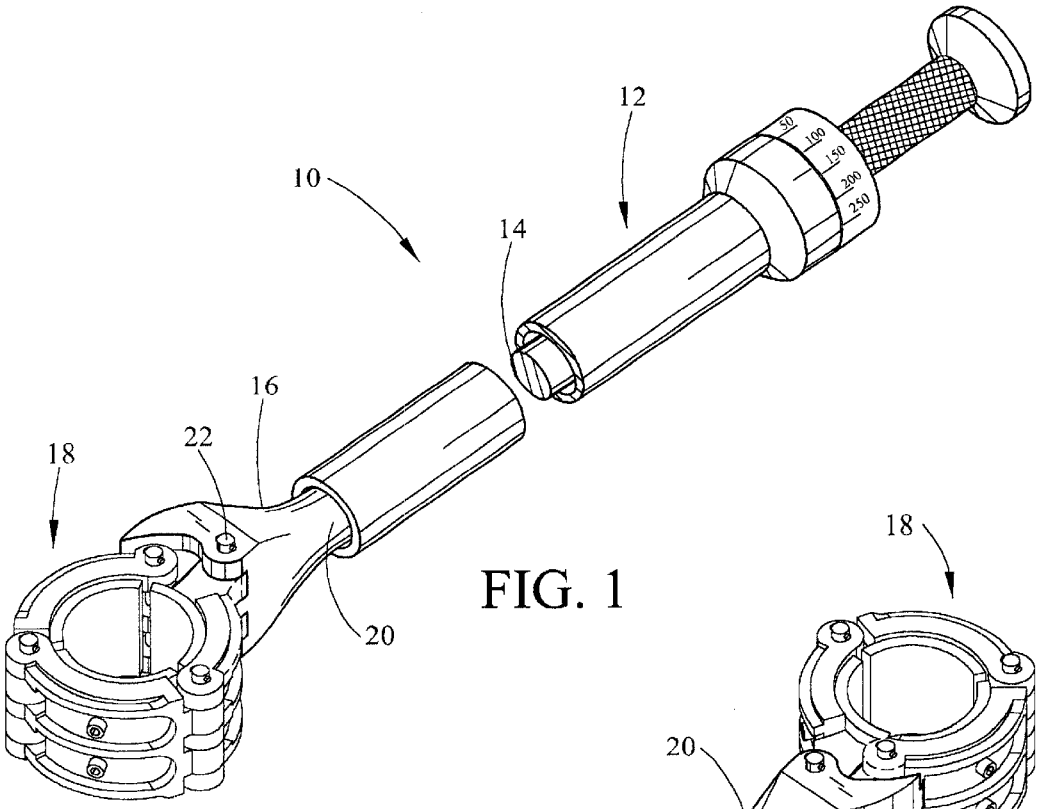
FIG. 1 is an isometric view of the hand tong wrench as obliquely viewed from the die end.

As illustrated in FIG. 1, the hand or manual tong wrench 10 is an assembly that includes a typical adjustable torque handle assembly 12 having a torque range of between 0–500 ft. lbs. adapted to a typical tong wrench head assembly 18 which includes an interchangeable die set for griping various size tubular members up to about 6 inches in diameter. An adapter or transition member 16 is custom designed to be typically connected by pivot pin 22 to any of the various types of tong wrench head assemblies 18 and is structurally connected to the integral shank portion 14 of the torque wrench at joint 20.

It is anticipated that the transition member 16 can take any configuration or be connected in any manner to any existing hand tong die head or incorporated into a custom built die head assembly.

Figure 2:
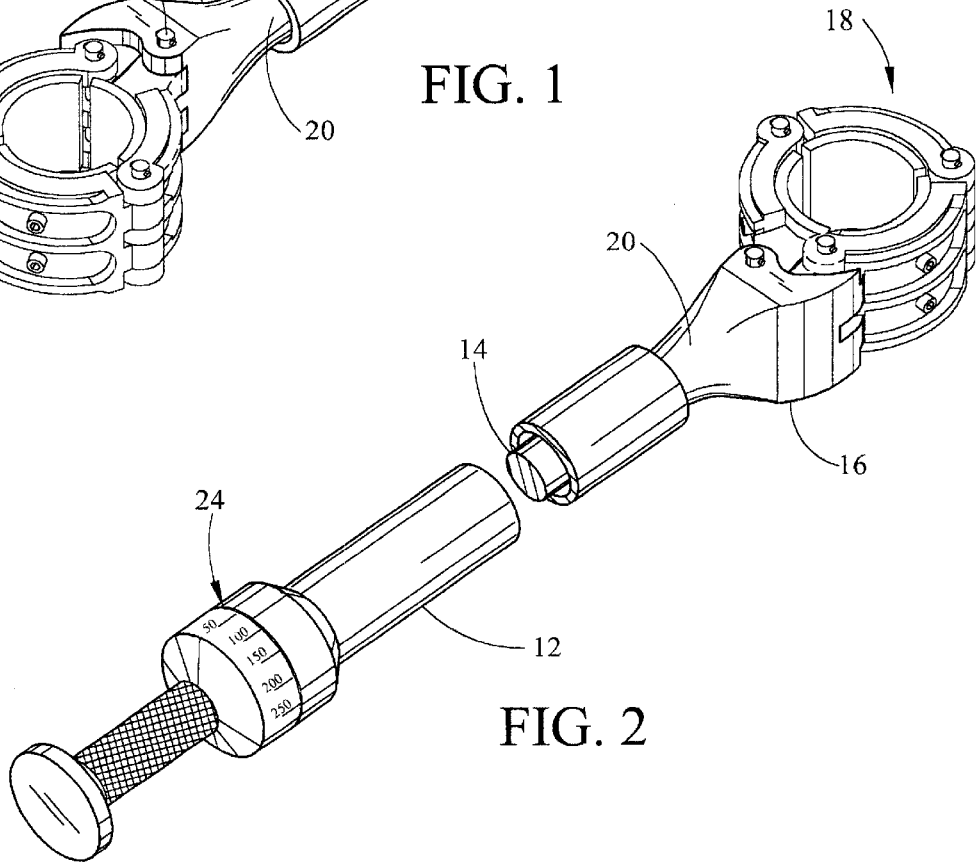
FIG. 2 is an isometric view of the hand tong wrench as obliquely viewed from the torque handle end.

The torque handle assembly 12 is typical of the type which provides a non-visual indication to the operator when a predetermined torque has been reached, such as an audible "click" or a movement providing "feel" to the operator when the predetermined torque has been reached, and has a means 24 for presetting an internal spring bias for a desired torque application typically as seen in FIG. 2. The handle, further defined as having a torque transfer axis and a shank portion generally coaxial therein and pivotally connected to a tubular handle, and having a coupling means releasably interconnecting said shank and handle so as to effect pivotal movement of the handle and create a tactile and audible indication to an operator when a predetermined but selectively variable torque is applied at said torque transfer axis in either rotational direction. The tool is generally precalibated using an electronic torque tester and calibrator.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A manual tong wrench for making up a joint between adjacent threaded tubular members comprising:

a) a pipe tong head assembly having a plurality of interlocking pivotal gripping jaws for engaging one of the threaded tubular members; and b) a handle adapted to said tong head assembly by which an actuating force is applied to said jaws to effect the making up of a joint, the handle defining a torque transfer axis and having a shank generally coaxial within and pivotally connected to a tubular handle, and coupling means releasably interconnecting said shank and handle so as to effect pivotal movement of the handle and create a tactile and audible indication to an operator when a predetermined but selectively variable torque is applied at said torque transfer axis in either rotational direction.

2. The manual tong wrench according to claim 1 wherein said shank is an integral component of a conventional torque wrench having means for selectively varying the torque setting at which the wrench will provide both an audible and tactile indication to the operator, said shank being connected directly to said tong head.

3. A method for manually applying a preset torque to a threaded tubular member when coupling one said member to another comprising the steps of:

a) providing a pipe tong head assembly having a plurality of interlocking pivotal gripping jaws for engaging the periphery of one of the coupling's threaded tubular members said tong head assembly adapted to a torque handle assembly by which an actuating force is applied to said jaws to effect the making up of a tubular pipe joint, the torque handle defining a torque transfer axis and having a shank portion of said tong head assembly located generally coaxially within and pivotally connected to a tubular handle, and coupling means releasably interconnecting said shank portion and handle so as to effect pivotal movement of the handle and thereby create a tactile and audible indication to an operator when a predetermined but selectively variable torque is applied at said torque transfer axis in either rotational direction; and b) securing said tong head assembly circumferentially to one of said tubular members and applying sufficient torque to said handle to insure a locking grip on said tubular member;

c) adjusting said torque handle assembly to a specific torque setting; and d) applying a manual force to handle portion of said torque handle assembly rotationally about said transfer axis until a tactile or audible indication of the preset torque level is perceived as result of movement of internal components located within said handle.

* * * * *